US006220255B1

(12) United States Patent
Hempel

(10) Patent No.: US 6,220,255 B1
(45) Date of Patent: Apr. 24, 2001

(54) FILLER STICKS FOR COSMETIC STICKS OR THE LIKE

(75) Inventor: Matthias Hempel, Heroldsberg (DE)

(73) Assignee: Nele Kosmetik GmbH, Igensdorf (DE)

( * ) Notice: Subject to any disclaimer, the term of this patent is extended or adjusted under 35 U.S.C. 154(b) by 0 days.

(21) Appl. No.: 09/427,665

(22) Filed: Oct. 27, 1999

(30) Foreign Application Priority Data

Oct. 29, 1998 (DE) ..... 198 49 819

(51) Int. Cl.[7] ..... A45D 40/24

(52) U.S. Cl. ..... 132/318; 132/320; 132/317; 249/68; 264/259

(58) Field of Search ..... 132/318, 317, 132/320; 604/1–3; 15/244.1, 209.1; 300/20, 21; 401/132, 156, 196, 80, 55, 92; 249/68, 118, 119, 129, 96; 264/259, 267, 275, 279, 297.1, 297.8

(56) References Cited

U.S. PATENT DOCUMENTS 4,664,615 * 5/1987 Ohtomo et al. ..... 264/259
4,670,206 * 6/1987 Nakagati et al. ..... 264/87
4,899,977 * 2/1990 Hempel ..... 264/275

FOREIGN PATENT DOCUMENTS 38 35 680 4/1990 (DE) .
40 16 474 11/1991 (DE) .
43 05 369 8/1994 (DE) .

* cited by examiner

*Primary Examiner*—Pedro Philogene
(74) *Attorney, Agent, or Firm*—Browdy and Neimark

(57) ABSTRACT

In a method for the manufacture of filler sticks for cosmetic sticks or the like, the filler stick being cast in a casing which is inserted in a mold, and the liquid casting compound rigidifying in the casing and in the mold, respectively, it is provided that the casing is housed in the holder at least with its lower end at an acute angle relative to the horizontal, that it can be filled from the free opposite end, the front of the lower end of the casing being followed by a closing portion, and the air displaced upon casting escaping through a vent, which extends outwards in the vicinity of the upper side of the lower front of the casing.

9 Claims, 1 Drawing Sheet

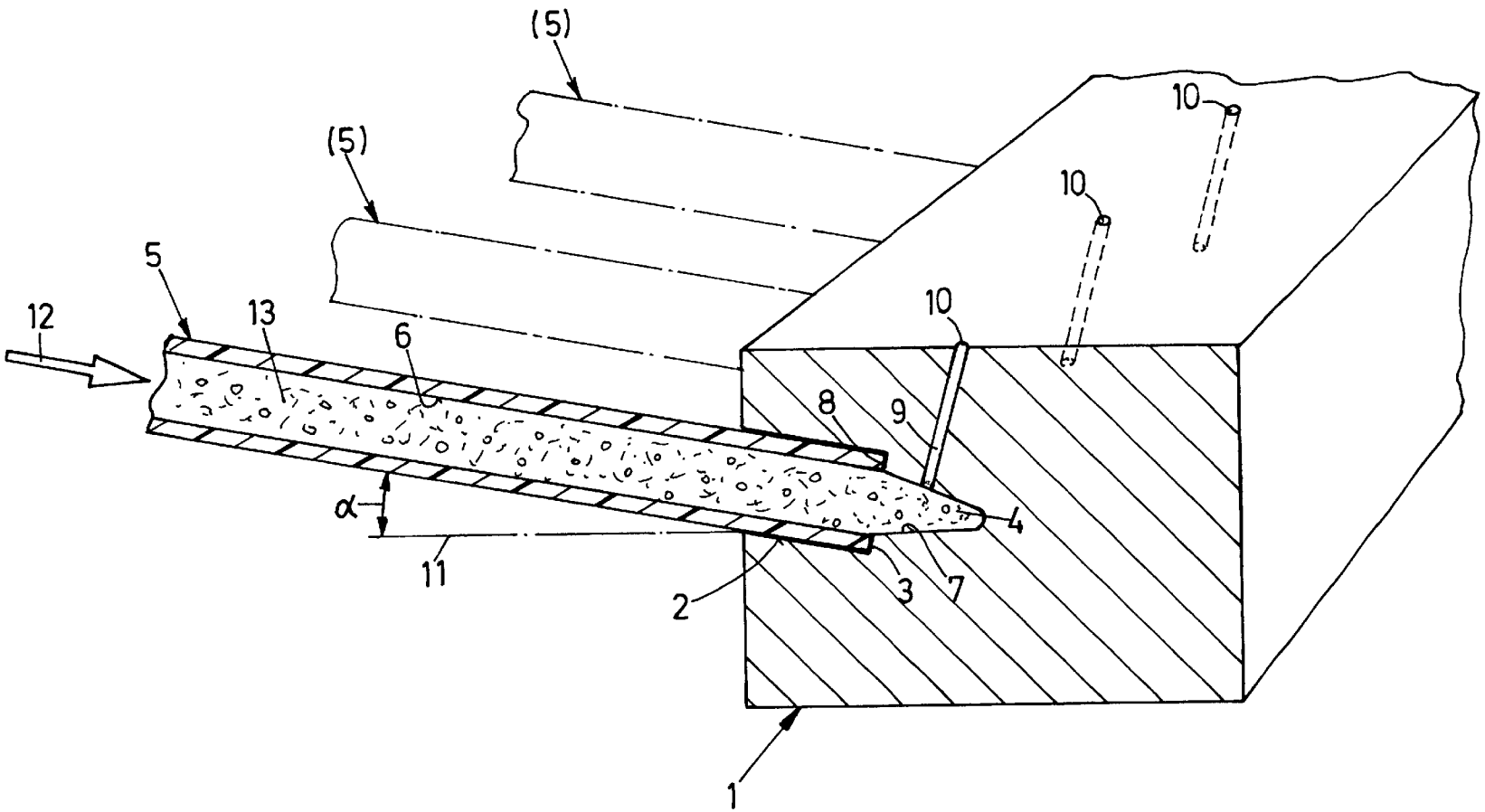
1
2
3
4
5
6
7
8
9
10
10
10
11
12
13
α
(5)
(5)

FILLER STICKS FOR COSMETIC STICKS OR THE LIKE

BACKGROUND OF THE INVENTION

1. Field of the Invention

The invention relates to a method and an apparatus for the manufacture of filler sticks for cosmetic sticks or the like, the filler stick being cast into a casing which is inserted in a mold and the liquid casting compound rigidifying in the casing and in the mold, respectively.

2. Background Art

A method of the generic type is known from German patent 38 35 680. In the known method, the casing is a plastic molding of the type of a tube which is slit along its generated surface and is inserted in a horizontal holder in such a way that a continuous front plate of the holder covers the plastic moldings so that only the slit is left free for the filler stick compound to be filled in. Horizontal casting of this type ensures an optimum structure of the filler stick, but the operating speed is not satisfactory.

DE 40 16 474 specifies a method and an apparatus according to which the casings, which are to be filled with the casting compound, are lodged to be driven in rotation and the free flowing compound is forced out of a reservoir and into the casings by the action of centrifugal force.

DE 27 18 957 C3 and DE 40 05 894 A1 teach to fill the filler stick compound via a nozzle into a vertically positioned casing from the rearward end thereof. Problems arise in particular in the case of comparatively long and thin casings due to the fact that any inclusion of air in the casing must be carefully avoided, i.e. a possibility must be created for the evacuation of air during the casting job.

In order to come up to this problem, it is known to proportion the liquid filler stick material by the aid of a kind of injection needle at some radial play towards the inside wall of the casing, the metering nozzle being inserted inside the casing as far as to the bottom thereof and then being lifted successively in accordance with the rising level within the casing by means of comparatively complicated kinematics. Consequently, the air can escape between the casting nozzle and the wall of the casing.

This mode of operation requires comparatively complicated mechanical machines to be provided for the accurate insertion of the casting nozzle, accurate positioning being necessary in the radial direction as well as accurate change of position in the vertical direction, depending on the filling level of the casing.

DE 43 03 563 teaches in the casing to arrange a closing member, which is in the vicinity of a first end of the casing at the beginning of the casting job and, as the casting process proceeds, is moved as far as into the vicinity of the second end of the casing, corresponding to the quantity of liquid filler stick compound supplied to the casing.

These known methods have the drawback that a core of a filler stick is produced in dependence on gravity, that soiling of the mold occurs and that structural flaws, air cavities and shrinkholes can be observed, conditioned by varying geometries and volumes of the metering chambers and the filler sticks as well as by a rough inner surface and by the tilting of the filler stick tube directly after filling.

SUMMARY OF THE INVENTION

It is an object of the invention to embody a method and an apparatus of the type mentioned at the outset so that the prior art drawbacks are avoided while a comparatively high production rate can be achieved.

According to the invention, this object is attained in that the casing is housed in the holder at least with its lower end at an acute angle to the horizontal, in that it can be filled from the free opposite end, the front of the lower end being followed preferably by a molding portion for the formation of a tip and the air displaced upon casting escaping through a vent, which extends outwards in the vicinity of the upper side of the lower front of the casing. Preferably, the angle of inclination towards the horizontal is approximately 10°.

The design according to the invention has succeeded in optimally combining the basic advantages of horizontal casting with a rapid and clean manufacturing process, simultaneously solving the problem of air displacement in an incredibly simple way.

In keeping with another embodiment of the invention, the casing is provided to be filled from a pre-metering chamber, which is connected with a metering pump, the interior space thereof being suited in volume and geometry to the interior of the casing. This helps attain very high production capacities, for instance a production of 100,000 pieces per eight hours when five boilers and in each case two metering chambers are used.

By advantage, the casing has a smooth inner surface, which will result in favorable filler stick properties.

The invention also relates to an apparatus for putting the method into practice, which is distinguished by a holder being provided for the accommodation by positive fit of at least a free lower end of a casing so that the casing is inclined at an acute angle of preferably 10° towards the horizontal, a molding portion being formed in the holder for the formation of a tip of a filler stick subsequent to the front of the casing and at least a vent extending upwards and outwards from the portion of the lower front of the casing.

Preferably, the closing portion is shaped as a molding portion for the formation of a tip of a filler stick.

Details of the invention will become apparent from the ensuing description of a preferred exemplary embodiment, taken in conjunction with the drawing.

BRIEF DESCRIPTION OF THE DRAWING

The drawing is a cut diagrammatic illustration of an apparatus according to the invention.

DESCRIPTION OF THE PREFERRED EMBODIMENT

An apparatus seen in the drawing comprises a holder 1 in the form of a metal block. A plurality of holes 2 are worked into this metal block, passing via an annular collar 3 into a molding portion 4 for the formation of a tip.

The hole 2 and the annular collar 3 are dimensioned for a casing 5 to be inserted in such a way that the inside wall 6 of the casing 5, preferably of a plastic casing, in the vicinity of the annular collar 3, passes into the inside wall 7 of the molding portion 4, i.e. the front 8 of the casing 5 rests on the annular collar 3 of the holder 1. A vent 9 extends from the molding portion 4 upwards, discharging in an outlet 10.

The hole 2 extends by an angle $\alpha$ of approximately 10° relative to the horizontal so that also the casing 5 is held at such an angle in the hole 2.

By means of a metering pump and a metering chamber (not seen in the drawing), a volume of liquid heated casting compound 13, which corresponds to the contents of the casing 5, is added in the direction of the arrow 12, the casting compound 13 filling the inside of the casing 5 and the mold portion 4 because of the inclination of the casing 5 by the angle α, the air displaced by the penetrating compound being able to escape through the vent 9.

Once the casting compound 13 has cured, the filler stick formed by the compound 13 and the casing 5 can be removed and another manufacturing cycle may start.

What is claimed is:

1. A method for the manufacture of filler sticks for cosmetic sticks at least one filler stick being cast in a casing, which is inserted in a mold and a liquid casting compound rigidifying in the casing and in the mold, respectively, wherein the casing, at least by its lower end, is housed in the holder at an acute angle to the horizontal so that it can be filled from the free opposite end, the front of the lower end of the casing being followed by a closing portion, and the air displaced upon casting escaping through a vent, which extends outwards in the vicinity of the lower front of the casing.

2. A method according to claim 1, wherein the closing portion is a molding portion for molding a tip.

3. A method according to claim 1, wherein the casing is inclined by an angle of approximately 10° relative to the horizontal.

4. A method according to claim 1, wherein the casing is filled from a premetering chamber, which is connected with a metering pump, the interior space thereof corresponding in volume and geometry to the interior space of the casing.

5. A method according to claim 1, wherein the casing has a smooth inner surface.

6. In a mechanical pencil comprising a filler stick, the improvement wherein said filler stick is manufactured according to claim 1.

7. An apparatus for the manufacture of filler sticks for cosmetic sticks at least one filler stick being cast in a casing, which is inserted in a mold and a liquid casting compound rigidifiying in the casing and in the mold, respectively, wherein a holder (1) is provided for the accommodation by positive fit of at least a free lower end of a casing (5) such that the casing (5) is inclined by an acute angle, relative to the horizontal, a closing portion being formed on the holder (1) subsequent to the front of the casing (5), and at least one vent (9) extending upwards and outwards from the vicinity of the lower front of the casing (5).

8. An apparatus according to claim 7, wherein the closing portion is a molding portion for molding a tip of the filler sticks.

9. The apparatus of claim 7 wherein said acute angle of inclination of said casing (5) is about 10°.

* * * * *